US005302164A

United States Patent [19]

Austin

[11] Patent Number: 5,302,164

[45] Date of Patent: Apr. 12, 1994

[54] ISOMETRIC BODY CONDITIONING APPARATUS

[76] Inventor: Edgar R. Austin, 9357 Christopher St., Cypress, Calif. 90630

[21] Appl. No.: 72,116

[22] Filed: Jun. 7, 1993

[51] Int. Cl.[5] ..... A63B 21/02

[52] U.S. Cl. ..... 482/91; 482/41; 482/39

[58] Field of Search ..... 482/91, 142, 38, 39, 482/41, 148, 23, 40, 42, 83, 87, 90, 91, 96, 133

[56] References Cited

U.S. PATENT DOCUMENTS 5,011,139 4/1991 Towley ..... 482/41
5,096,187 3/1992 Marples ..... 482/41
5,162,030 11/1992 Tanski ..... 482/91

*Primary Examiner*—Stephen R. Crow
*Attorney, Agent, or Firm*—Plante Straiss & Vanderburgh

[57] ABSTRACT

An exercise apparatus for performing isometric body exercises such as bar dips and vertical leg lifts which includes a standard having a straight upper leg with a dependent inclined lower leg having a lower support plate. A handlebar head is removably supported on the standard and a crossbar is located above the standard and extends laterally with distally located handles. A pair of walls struts are supported on the head such that the apparatus may be located in a corner of a room wherein the two struts bear against the adjacent walls of the corner.

21 Claims, 4 Drawing Sheets

10
58
66
62
47
44
46
24
60
42
30
31
56
36
47
34
64
26
48
32
31
28
12
29
33
16
14
18
20
22
23

59
63
61
67
65

ISOMETRIC BODY CONDITIONING APPARATUS

BACKGROUND OF THE INVENTION

1. Field of Invention

This invention relates to an isometric body conditioning apparatus and, in particular, to a very compact and portable bar dip and vertical leg lift apparatus.

2. Brief Statement of the Prior Art

Isometric body conditioning equipment is commonly quite bulky, and is not portable. Often it is a part of a multistation gym and occupies a considerable amount of floor space. This construction is considered necessary and acceptable in the industry to provide substantial strength to absorb up to several hundred pounds applied to levers, arms, etc., without failure or without flexing or bending. Such equipment, however, is not ideally suited to home use because of its bulk and permanent character.

OBJECTIVES OF THE INVENTION

It is an objective of this invention to provide a portable isometric body conditioning apparatus suitable for bar dip and/or vertical leg lift applications.

It is also an objective of this invention to provide the aforementioned isometric body conditioning apparatus in a compact, light weight construction.

It is a further object of this invention to provide the aforementioned isometric body conditioning apparatus which is suitable for installation in a small, corner area of a room.

It is a still further objective of this invention to provide the aforementioned isometric body conditioning apparatus with a structure permitting it to be readily disassembled and stored.

Other and related objectives will be apparent from the following description of the invention.

BRIEF DESCRIPTION OF THE INVENTION

This invention comprises an exercise apparatus suitable for isometric body conditioning, such as for bar dip and vertical leg lift applications which comprises a standard having a straight upper leg with a dependant, inclined lower leg extending outwardly at an angle of approximately 45° with a lower foot or support plate. The exercise apparatus also includes a handlebar head removably supported on the upper end of the standard with a cross bar located above the standard and extending laterally therefrom, handlebars with handles distally located at opposite lateral extremities of the handlebar cross bar and a pair of wall struts coplanar with and symmetrically supported on the head, extending in a direction opposite that of the handle bars and oriented on the head to provide an included angle between the struts of 90°, whereby the entire apparatus may be located in a corner of a room, the bottom plate of the standard resting on the floor and the outboard ends of the two struts bearing against the adjacent walls of the corner.

BRIEF DESCRIPTION OF THE FIGURES

The invention will be described with reference to the FIGURES, of which.

DESCRIPTION OF PREFERRED EMBODIMENT

Figures 1, 1A, 1B:
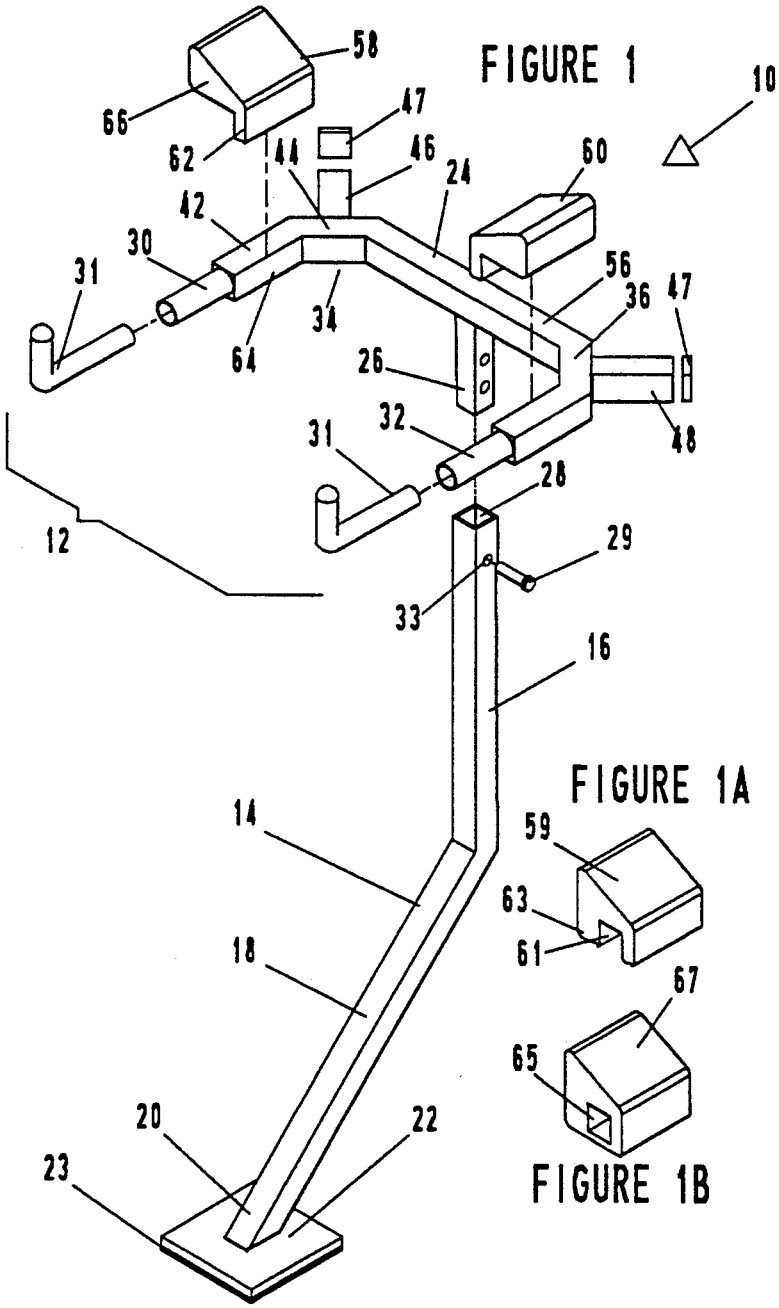
FIG. 1 is a perspective exploded illustration of the isometric body conditioning apparatus of the invention.
FIGS. 1A and 1B illustrate alternative arm pads for use with the apparatus of the invention.

FIG. 1 is a perspective view of the isometric body conditioning apparatus 10 of this invention, shown in an exploded illustration with the head 12 removed from and supported above the standard 14. The invention comprises a standard 14 which has an upper, vertical section or leg 16 and a downwardly dependant and inclined base leg 18 which is inclined at an angle of 45° to the longitudinal axis of the upper vertical leg 16. At its lowermost end 20, the standard 14 has a support plate 22 which is suitable to rest on a floor and which, if desired, can have a suitable gripping surface, e.g., rubber pad 23, etc., on its undersurface.

The head 12 of the isometric body conditioning apparatus 10 has a cross bar 24 which has a downwardly dependant orthogonal stub shaft 26 that can be received in the open, upper end 28 of the standard 14. For this purpose, the apparatus is constructed of round or square tubular members; square tubular members as shown are preferred and, most preferably are of a standard suitable dimension, e.g., 2 inch square tubular steel members. Although metal, and preferably steel, tubes are used, it would be possible to form the entire apparatus of reinforced, high strength plastics by injection molding. The lower cost, availability and reliable strength of steel, however, makes this the material of choice. The stub shaft 26 is also tubular and rectangular in cross section and has an outer dimension which is sufficiently small to permit it to be received snugly within the open upper end 28 of the upper leg 16 of the standard 14. Preferably, the shaft 26 has several through holes which can be aligned with hole 33 of leg 16 and secured by pin 29 for vertical adjustments.

Figure 2:
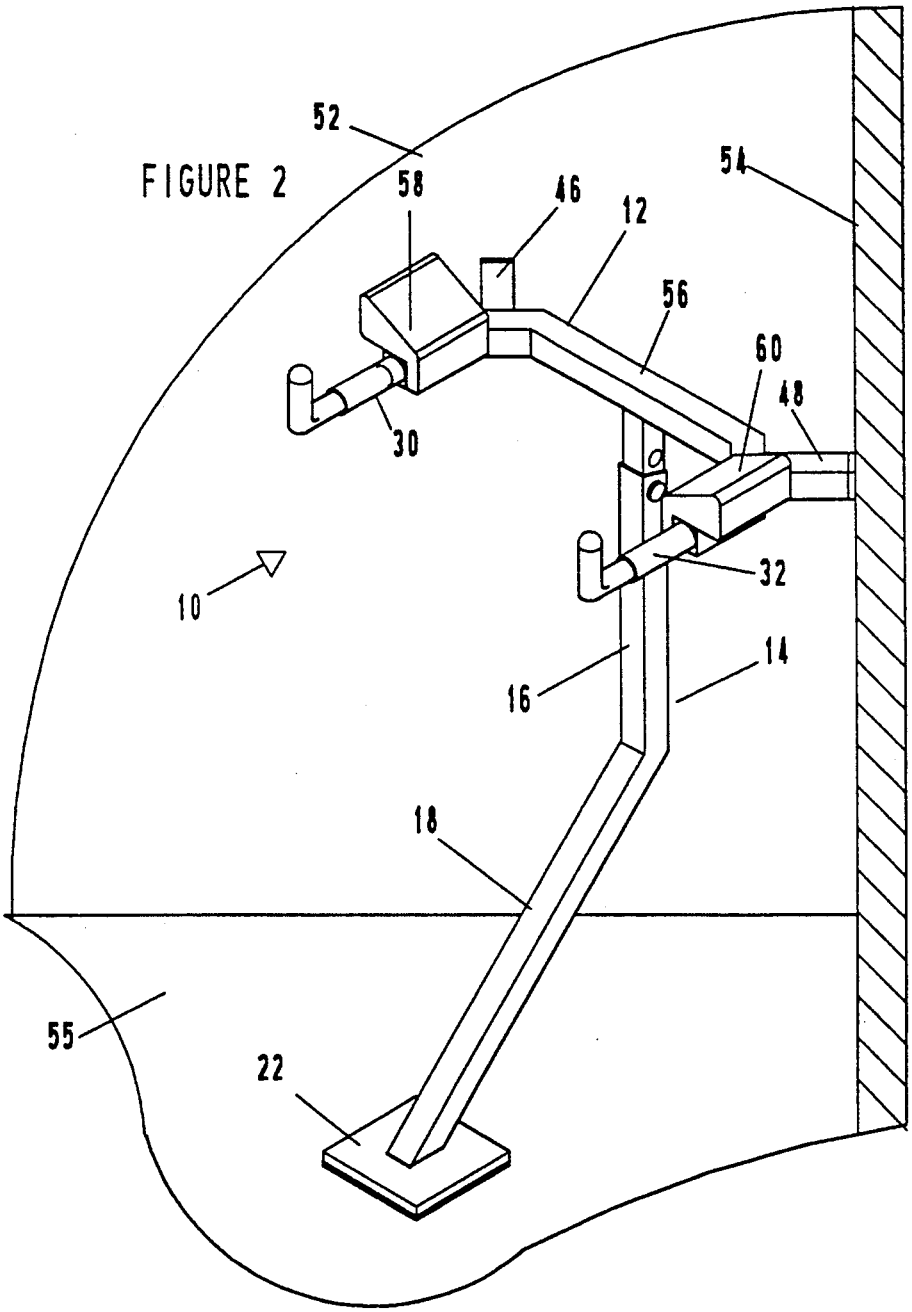
FIG. 2 is a perspective view of the assembled apparatus.

The cross bar 24 of the head 12 extends laterally from the standard 14 and rests above it, as shown in FIG. 2. The cross bar supports, at its outer extremities, a pair of hand grips 30 and 32, one each, located at opposite sides of the head 12. The hand grips 30 and 32 can be cylindrical or can be of any suitable contour which is comfortable for gripping, e.g., recesses or convoluted external surfaces for the user fingers can be provided if desired. A pair of L-shaped hand grips 31 are also provided and these L-shaped hand grips are slidably received in the open ends of grips 30 and 32. Preferably grips 31 have an upturned end for ease of gripping and are snugly received in grips 30 and 32 so that they can be adjusted by turning, or moving inwardly or outwardly. They can also be removed entirely from the apparatus.

The hand grips 30 and 32 are preferably covered with a rubber or plastic foam layer and are fixedly supported by extension arms 34 and 36 which are integral with the cross bar 24, thereby forming handlebars 56. In the preferred and illustrated embodiment, the support arms 34 and 36 have a first straight section 42 and a second, inclined section 44 which is preferably inclined at a 45 degree angle to the first section 42, thereby providing an included right angle between the longitudinal axes of the inclined sections. The handlebars 56 are preferably formed as a one-piece component from a single metal tube which is bent to the illustrated configuration.

Useful accessories to the apparatus are the forearm pads 58 and 60 which are secured to the upper surfaces of the sections 42 of the support arms 34 and 36. The pads can be molded of compressible plastic foam or can be covered with rubber or plastic foam as needed for comfort. The forearm pads can have shapes which at least partially surround and then are supported by the sections 42 of the handlebars 56. In the illustrated embodiment, the pads have a generally L-shape with a face rim 62 which rests against the inside surfaces 64 of the support arms 34 and 36. Preferably, for comfort, the top surfaces 66 of the forearm pads 58 and 60 are inclined upwardly in a lateral direction, conforming to the natural incline of one's forearms when using the apparatus 10, thereby preventing one's arms from slipping over the outer edges of the pads. The pads 58 and 60 can be secured to the support arms 34 and 36 with any suitable attachment means, e.g., VELCRO fabric fasteners, snap fasteners, or permanent bonding with cement or mechanical fasteners. Alternative pad configurations are shown in FIGS. 1A and 1B. The pads can have an inverted U-shape as shown in FIG. 1A with an open channel 61 on the underside of pad 59, which snugly fits over arm 42. If desired, the pad can have an enclosed channel 65 as shown for pad 67 in FIG. 1B. The pads formed as shown in FIGS. 1A and 1B there would be less need to use additional attachment means such as adhesives or VELCRO fasteners.

A pair of wall support struts 46 and 48 are provided, one each, centrally located on the inclined sections 44 of the extension arms 34 and 36 and these struts extend orthogonally to the inclined sections 44, thereby extending forward at an included right angle. Preferably, pads 47 of rubber or plastic are included on the ends of the struts 44 and 46 to bear against wall surfaces.

FIG. 2 illustrates the isometric body conditioning apparatus 10 in its assembled condition. In this assembly, the foot support plate 22 rests on a supporting floor surface, adjacent a corner of a room so that the support struts 46 and 48 will bear against the surfaces of the adjacent walls of the corner.

Figure 3:
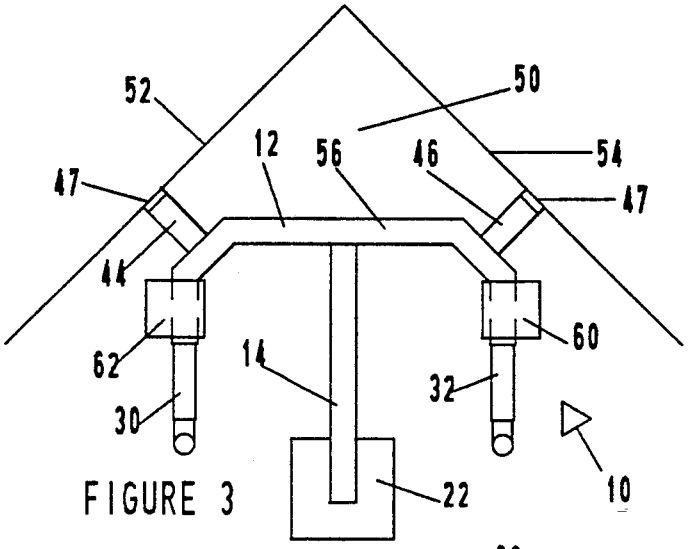
FIG. 3 is a top plan view of the isometric body conditioning apparatus correctly located in a corner of a room.

Referring now to FIG. 3, the isometric body conditioning apparatus 10 of the invention is illustrated in its correct installation in the corner 50 of a room with the foot support plate 22 resting on the floor of the room and the support struts 44 and 46 bearing against adjoining walls 52 and 54 of the corner. In this-position, it can be seen that a downward force exerted on the handlebars 56 of the head 12 of the apparatus 10 will result in compressive loading of the apparatus, with the walls 52 and 54 supporting the apparatus 10 against tilting or movement and with the entire downward load carried by the vertical support 14.

Figure 4:
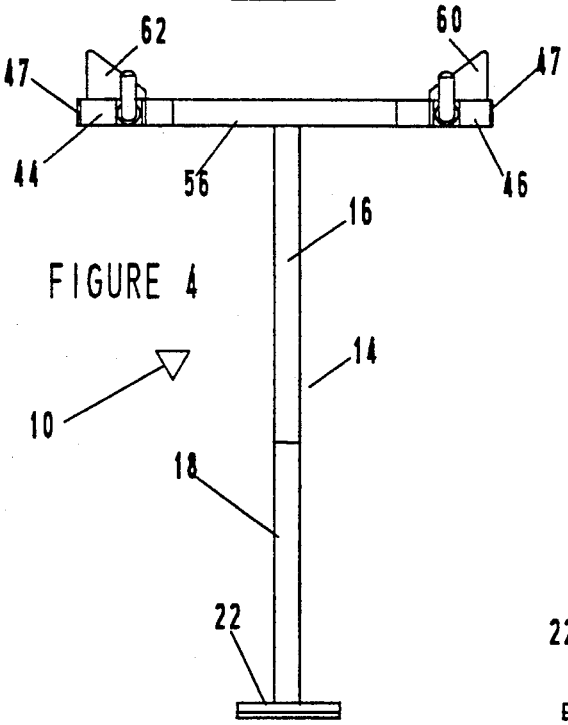
FIG. 4 is a front elevational view of the isometric body conditioning apparatus.
Figure 5:
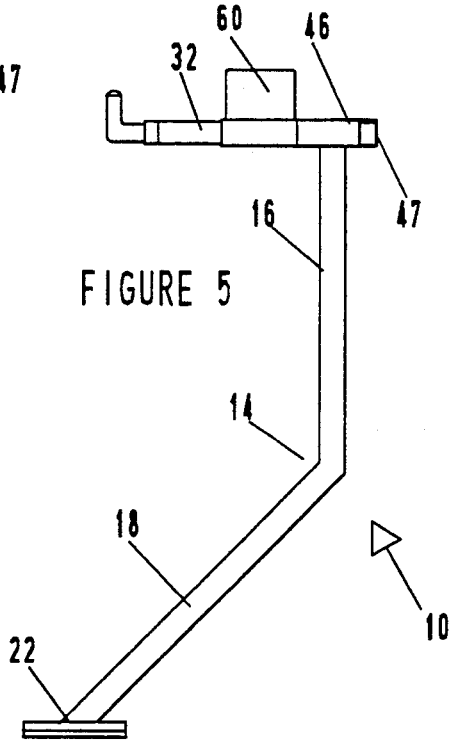
FIG. 5 is a side elevational view of the isometric body conditioning apparatus of this invention.

As apparent from FIGS. 4 and 5, the downward thrust of loads applied to the body conditioning apparatus will exert a vertical downward component on the floor support plate 22, compressing the pad 23 and greatly increasing its frictional resistance to displacement. Similarly, the downward loading on the head 12 will also exert lateral forces on the support struts 44 and 46 which are resisted and absorbed by the wall 52 and 54. The result is that the isometric body conditioning apparatus when properly located in a corner as illustrated, is a very stable apparatus exhibiting no detectable flexing or movement and highly resistant to failure because of the simplicity of its construction.

Figure 6:
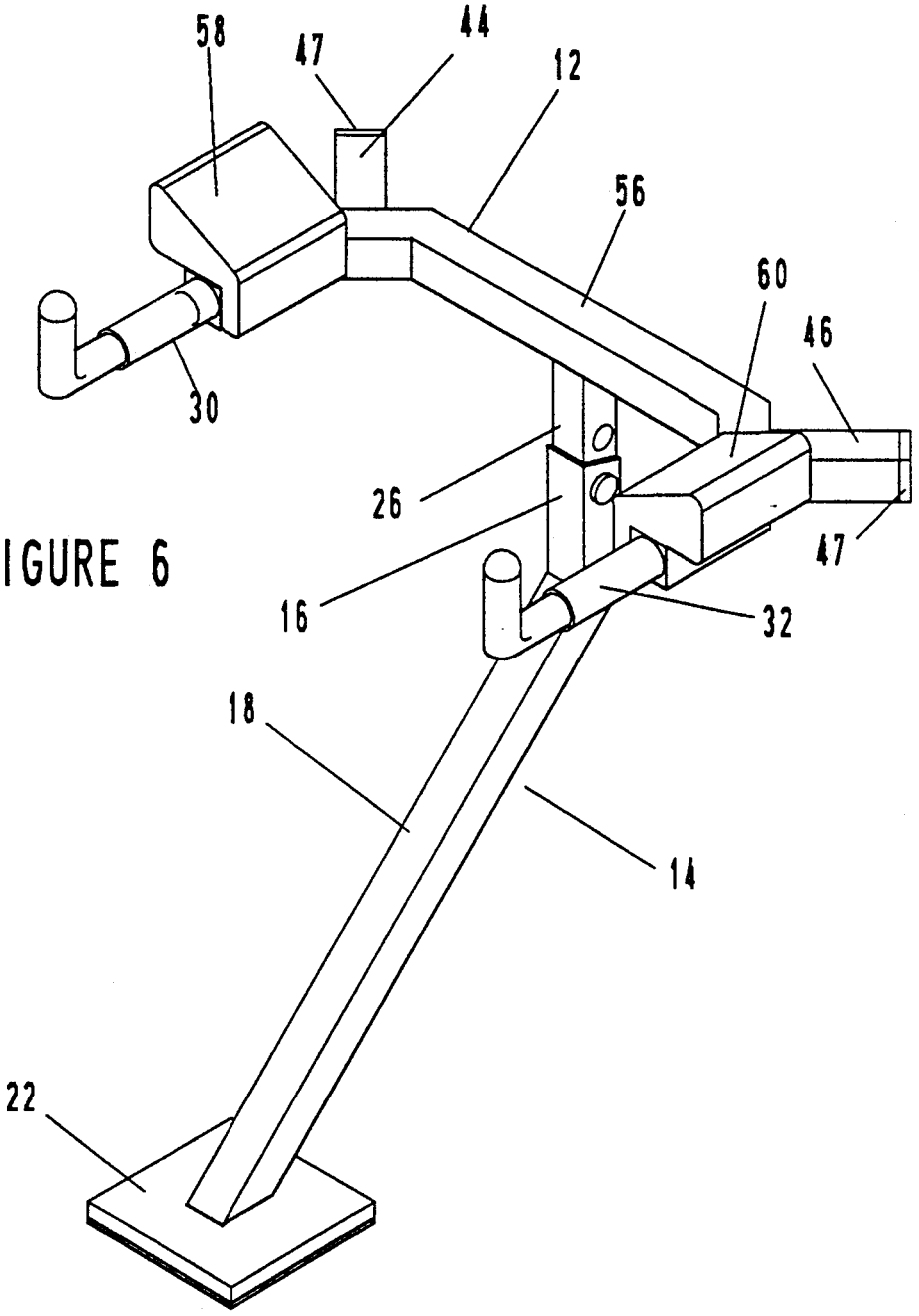
FIG. 6 is a perspective view of a modification useful for handicapped persons confined to wheelchairs.

Another application of the invention is use by handicapped persons who are confined to wheelchairs. FIG. 6 illustrates a modified embodiment of the apparatus. In this modification, the height of the handlebars 56 is reduced by shortening of the vertical leg 16 of the standard 14. This locates the handlebars 56 at an elevation above the floor which will permit a handicapped person to move a wheelchair into the apparatus, with the chair straddling the inclined leg 18 and with the handles 30 and 32 located directly over the arm rests of the wheelchair. The handicapped person can then lift himself out of the wheelchair by transferring his weight to the apparatus.

Despite its compactness, the body conditioning apparatus of the invention is extremely strong and can support the weight of users without flexing. Despite its strength, the apparatus is extremely compact and can be readily dismantled and stored as apparent from the illustration of FIG. 1. Also, as apparent from the illustration of FIG. 3, the apparatus can be installed in a corner of a room, often in an unused area where it is out of the way of other exercise equipment.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. An exercise apparatus which comprises:

a. a standard having a straight upper leg with a longitudinal axis, and a dependent, inclined lower leg extending outwardly from said axis by a brace distance, and having a support plate on its lower end;

b. a handle bar head being supported on the upper end of said standard and having (1) a cross bar located above said standard and extending laterally to opposite sides thereof;

(2) a pair of handle bars, one each, distally located at opposite lateral extremities of said cross bar and coplanar therewith, each handle bar extending in the direction of said inclined lower leg, but terminating at a distance less than said brace distance; and (3) a pair of wall struts, coplanar with and supported symmetrically on, and extending from, said head opposite the direction of said handle bars, and oriented on said head to provide an included angle between said struts of 90 degrees, whereby said apparatus can be placed in a right angle corner of a room with said standard in a vertical orientation and said lower leg thereof resting on the floor, and each of said struts bearing against adjacent walls.

2. The exercise apparatus of claim 1 wherein the lower leg of said standard is inclined at an angle of 45 degrees to said axis.

3. The exercise apparatus of claim 1 wherein said head is removably supported on the upper end of said standard.

4. The exercise apparatus of claim 3 wherein the vertical elevation of said head is adjustable.

5. The exercise apparatus of claim 4 wherein said head has a centrally located stub shaft which is slidably received within the upper leg of said standard.

6. The exercise apparatus of claim 5 including a plurality of through apertures in said stub shaft and at least one through aperture in said upper leg with pin means to insert in aligned apertures of said stub shaft and said upper leg to fixedly secure said head to said standard.

7. The exercise apparatus of claim 1 wherein said handle bars have cylindrical hand grip sections.

8. The exercise apparatus of claim 7 including a pair of L-shaped hand grips which are removably received in said cylindrical hand grip sections.

9. The exercise apparatus of claim 1 wherein said standard and head are formed of square tubular members.

10. The exercise apparatus of claim 1 wherein said struts distally bear pads to rest against respective walls.

11. The exercise apparatus of claim 1 wherein said handle bars are integral with said cross bar which is of single-piece construction.

12. The exercise apparatus of claim 9 wherein said handle bars have cylindrical hand grip sections.

13. The exercise apparatus of claim 12 including frictional facing material about said hand grip sections.

14. The exercise apparatus of claim 1 wherein said cross bar includes outward sections which are inclined at 45 degrees to the cross bar and at an included right angle which is bisected by said inclined leg of said standard.

15. The exercise apparatus of claim 14 wherein said handle bars and outward sections are integral with said cross bar, formed of single-piece construction.

16. The exercise apparatus of claim 14 wherein said struts are located, one each, on said outward sections and extend orthogonally thereto.

17. The exercise apparatus of claim 1 including a pair of forearm pads secured to said apparatus with one each resting on a respective handle of said handlebars to provide support for a user's forearms.

18. The exercise apparatus of claim 17 wherein said forearm pads have an inclined upper surface, slanted upwardly in a lateral direction.

19. The exercise apparatus of claim 18 wherein said forearm pads are removably attached to said apparatus.

20. The exercise apparatus of claim 19 wherein said forearm pads have an orthogonal medial edge which overlaps the medial wall of its respective handle.

21. The exercise apparatus of claim 18 wherein said forearm pads have a channel which receives its respective handle of said handlebars.

* * * * *